US010190296B2

(12) United States Patent
McKendrick et al.

(10) Patent No.: US 10,190,296 B2
(45) Date of Patent: Jan. 29, 2019

(54) PLUMBING APPARATUS

(71) Applicant: McAlpine & Co. Limited, Glasgow, Strathclyde (GB)

(72) Inventors: Chris McKendrick, Glasgow (GB); James Edward McAlpine, Glasgow (GB)

(73) Assignee: McAlpine & Co. Ltd. (GB)

( * ) Notice: Subject to any disclaimer, the term of this patent is extended or adjusted under 35 U.S.C. 154(b) by 44 days.

(21) Appl. No.: 15/123,826

(22) PCT Filed: Mar. 24, 2015

(86) PCT No.: PCT/GB2015/050881
§ 371 (c)(1),
(2) Date: Sep. 6, 2016

(87) PCT Pub. No.: WO2015/145141
PCT Pub. Date: Oct. 1, 2015

(65) Prior Publication Data

US 2017/0016220 A1 Jan. 19, 2017

(30) Foreign Application Priority Data

Mar. 24, 2014 (GB) ..... 1405235.1

(51) Int. Cl.
*E03C 1/232* (2006.01)
*E03C 1/04* (2006.01)
(Continued)

(52) U.S. Cl.
CPC ..... *E03C 1/232* (2013.01); *E03C 1/04* (2013.01); *E03C 1/14* (2013.01); *E03C 1/2306* (2013.01);
(Continued)

(58) Field of Classification Search
CPC . E03C 1/232; E03C 1/2306; E03C 2001/2315
See application file for complete search history.

(56) References Cited

U.S. PATENT DOCUMENTS 851,513 A * 4/1907 Guthrie ..... E03C 1/23 4/686
1,781,719 A 11/1930 Darling
(Continued)

FOREIGN PATENT DOCUMENTS

| | | |
|---|---|---|
| FR | 2164018 | 7/1973 |
| NL | 1032117 | 1/2008 |
| WO | 0177448 | 10/2001 |

OTHER PUBLICATIONS

International Search Report corresponding to Int'l Pat. Appl. No. PCT/GB2015/050881, dated Jun. 18, 2015, 3 pages.

*Primary Examiner* — Janie Loeppke
(74) *Attorney, Agent, or Firm* — Tarolli, Sundheim, Covell & Tummino LLP

(57) ABSTRACT

The present invention provides an apparatus for speeding the draining of a bathing vessel, and is particularly suitable for speeding the draining of walk-in bath tubs. The apparatus can be concealed in a corner of the walk-in bathtub and comprises an actuation mechanism to open and close the draining outlet which needs minimal force to be actuated, making it especially suitable for use by elderly people. The apparatus can also incorporate a security by-pass drain to avoid overfilling of the bathtub. The apparatus can be installed in most or all standard bathrooms with few adaptations.

5 Claims, 2 Drawing Sheets

(51) Int. Cl.
*E03C 1/14* (2006.01)
*E03C 1/23* (2006.01)
*E03C 1/12* (2006.01)

(52) U.S. Cl.
CPC ..... *E03C 2001/1206* (2013.01); *E03C 2001/2315* (2013.01)

(56) References Cited

U.S. PATENT DOCUMENTS 1,848,521 A * 3/1932 Fleck ..... E03C 1/23 4/692
4,777,676 A * 10/1988 Ericson ..... E03C 1/14 4/286
6,415,463 B1 * 7/2002 Slothower ..... E03C 1/232 4/683

* cited by examiner

PLUMBING APPARATUS

RELATED APPLICATIONS

The present application is a U.S. National Stage under 35 USC 371 patent application, claiming priority to Serial No. PCT/GB2015/050881, filed on Mar. 24, 2015, which claims priority from GB 1405235.1, filed on Mar. 24, 2014, both of which are incorporated herein by reference.

FIELD OF THE INVENTION

The present invention relates to an improved plumbing apparatus for increasing the speed of drainage of a washing vessel. Particularly but not exclusively, the present invention relates to an improved plumbing apparatus for increasing the speed of drainage of a bath tub.

BACKGROUND OF THE INVENTION

Various types of vessels are known for a person to wash themselves; for example bath tubs, sinks, shower trays or the like. All of these vessels generally require draining after use. Current trends are for faster draining vessels, particularly for bath tubs which contain significant volumes of water.

Drainage speed is dependent on a number of factors including the size of the outlet; larger outlets giving greater drainage speeds. However, large outlets are not always desirable. For example, the outlet is normally sealed by a plug which has to be lifted out of the outlet to permit drainage to commence and large plugs may be considered unsightly and difficult to remove due to the larger surface area which the weight of the water in the bath tub can act down on.

This is particularly a problem in bath tubs provided with an access door in a side of the bath. Such bath tubs are used by elderly or frail people who would normally struggle to get in and out of a normal bath tub. These bath tubs often accommodate a seat for the user to sit on, avoiding the need for the user to lower themselves fully into the bath tub. The provision of an access door and a seat means the sides of the bath tub are generally taller than those of a conventional bath tub. This exacerbates the drainage issue as the user has to wait until this taller bath tub has substantially emptied before opening the door.

SUMMARY OF THE INVENTION

According to a first aspect of the present invention there is provided an apparatus for increasing the speed of drainage of a washing vessel such as a bath tub, basin or the like, the apparatus comprising:

a body having a body inlet adapted to be connected to a washing vessel outlet and a body outlet adapted to be connected to soil stack;

a barrier located between the body inlet and the body outlet, the barrier being movable between a fill position in which the barrier prevents the flow of fluid from the body inlet to the body outlet and a drainage position in which the barrier permits the flow of fluid from the body inlet to the body outlet; and a barrier by-pass, the barrier by-pass being adapted to permit fluid otherwise being prevented from flowing through the body by the barrier to by-pass the barrier when the barrier is in the fill position and, in use, when a threshold depth of water is exceeded inside the washing vessel.

In at least one embodiment of the present invention providing a barrier located between the body inlet and the body outlet permits a larger washing vessel outlet to be used than in conventional tubs. Furthermore, providing a bypass can prevent an overflow condition being established in the washing vessel.

The barrier may be annular. An annular barrier has a much reduced surface area upon which to build up a head of pressure which may inhibit opening of the body outlet.

The barrier may be adapted to form a seal with the body.

In this embodiment, the barrier forms a seal with the body when moving from the drainage position to the fill position.

In this embodiment, in moving from the drainage position to the fill position, the seal between the barrier and the body is broken The seal may be an elastomeric seal.

Particularly the seal may comprise rubber.

The seal may be in a vertical plane.

Preferably the seal is in a horizontal plane. A seal in a horizontal plane is preferred as weight of water acting on the barrier can be utilised to hold the barrier in the fill position.

The barrier may be actuable between the drainage position and the fill position.

The barrier may be remotely actuable between the drainage position and the fill position.

The barrier may be actuable between the drainage position and the fill position by means of a push-push mechanism.

Alternatively, the barrier may be actuable between the drainage position and the fill position by means of a push-pull mechanism.

In further alternative or additional embodiments, the barrier may be actuable by rotation of an actuator.

In some embodiments, the actuator may be a lever.

In these and other embodiments, the actuator may be a handle. In this embodiment the lifting the handle may move the barrier from the fill position to the drainage position.

The actuator may be connected to the barrier by an actuator mechanism.

The actuator mechanism may convert a movement in one direction of the actuator to a movement in a different or additional direction of the barrier. For example the actuator mechanism may convert rotational movement of the actuator into vertical movement of the barrier.

In some embodiments, the actuator mechanism may convert rotational movement of the actuator into rotational and vertical movement of the barrier. In this embodiment, the actuator mechanism may at least partially a helical arrangement.

The barrier may be adapted to move vertically between the fill and drainage positions.

Alternatively or additionally, the barrier may be adapted to move horizontally between the fill and drainage positions.

Alternatively or additionally, the barrier may be adapted to move rotationally between the fill and drainage positions.

In alternative embodiments the barrier may comprise a first portion and a second portion.

In these and other embodiments the barrier first portion may be movable with respect to a barrier second portion.

Moving the barrier first portion with respect to the barrier second portion, in some embodiments, moves the barrier from the fill position to the drainage position.

The threshold height of water may be an overflow height of water determined by the washing vessel dimensions.

The bypass may be integral with the body.

The bypass may comprise a bypass inlet, the bypass inlet being adapted to receive fluid from the body.

The bypass inlet may be between the body inlet and the body outlet.

The bypass inlet may be between the body inlet and the barrier.

The bypass inlet may be adapted to receive fluid from a body inlet side of the barrier.

Alternatively or additionally, the bypass may be adapted to receive fluid from the washing vessel outlet.

Providing an apparatus which allows the barrier to be by-passed in an overflow situation is particularly useful, as the apparatus of the present invention can be utilised as an overflow obviating the need for holes and the like to be provided at a desired maximum fill level.

The bypass may comprise a bypass outlet, the bypass outlet being adapted to deliver fluid flowing through the bypass to the body outlet.

The bypass may extend upwardly from the barrier.

The bypass may define a weir.

The weir may be lie on a horizontal plane.

The weir horizontal plane may be the same as a washing vessel threshold height of water horizontal plane.

The bypass may be tubular.

In this case the weir may be a circumferential weir.

BRIEF DESCRIPTION OF THE DRAWINGS

An embodiment of the present invention will now be described in which.

and

Figure 1:
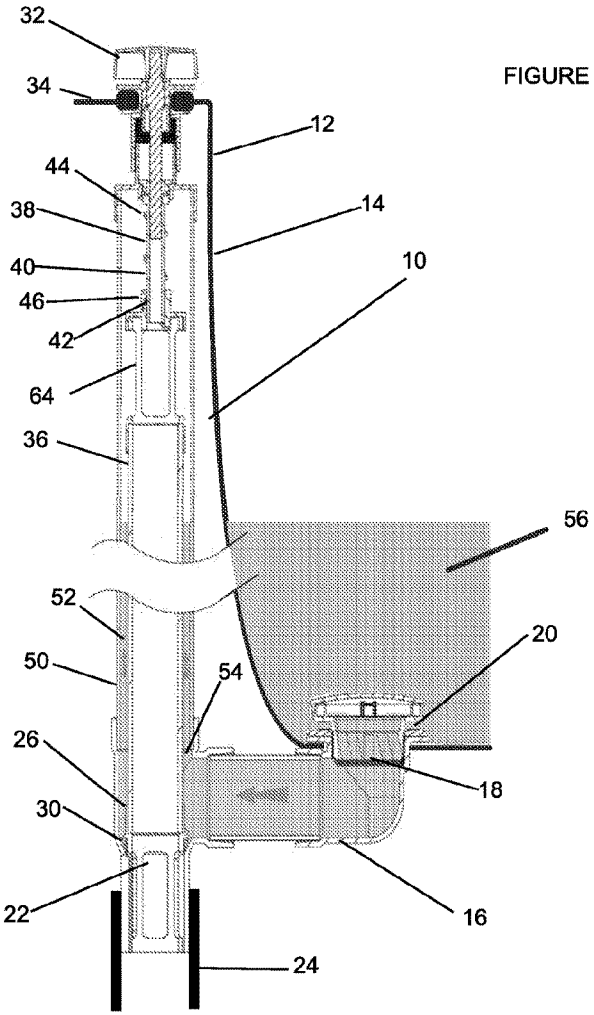
FIG. 1 is a section of an apparatus for increasing the speed of drainage of a washing vessel according to a first embodiment of the present invention, the apparatus being shown in a fill position.
Figure 3:
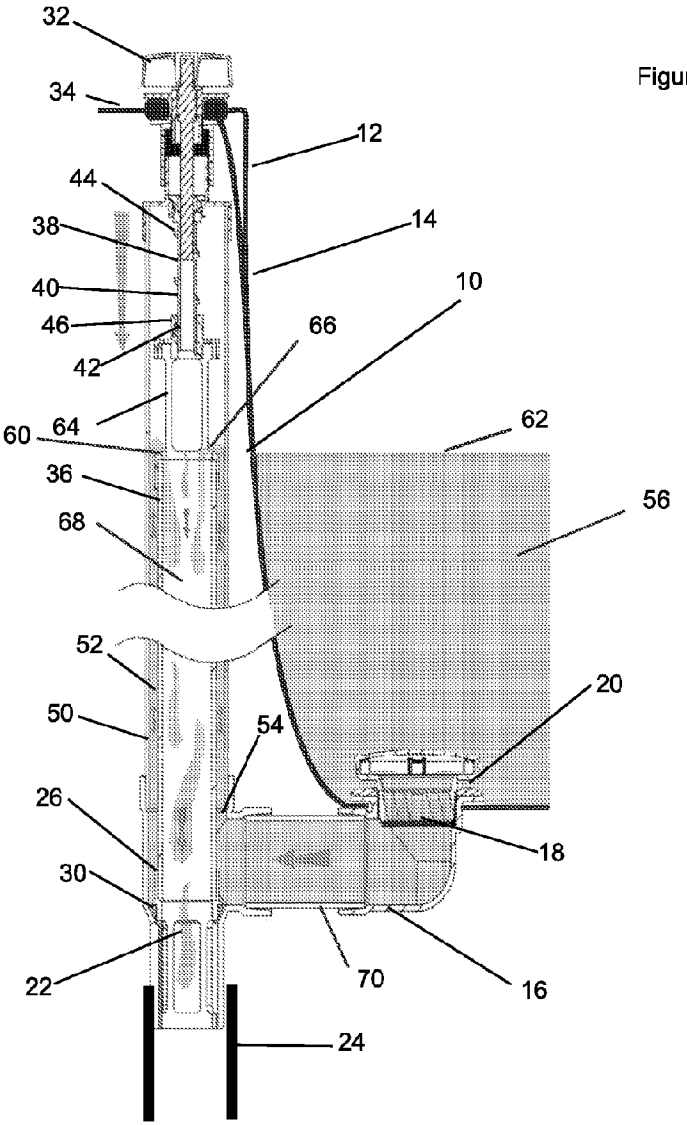

FIG. 3 is a section of the apparatus of FIG. 1 when an overflow condition has been reached.

DETAILED DESCRIPTION OF THE DRAWINGS

Referring firstly to FIG. 1, there is shown an apparatus generally indicated by reference numeral 10 for increasing the speed of drainage of a washing vessel 12, in this case a walk-in bath tub 14, according to a first embodiment of the present invention, the apparatus 10 being shown in a fill position.

The apparatus 10 comprises a body 16, having a body inlet 18, adapted to be connected to an enlarged bath tub outlet 20, and a body outlet 22 adapted to be connected to a soil stack 24. The apparatus 10 further comprises a barrier 26 located between the body inlet 18 and the body outlet 22, the barrier 26 forming an annular seal 30 with the body 16 to prevent flow between the body inlet 18 and the body outlet 22.

Figure 2:
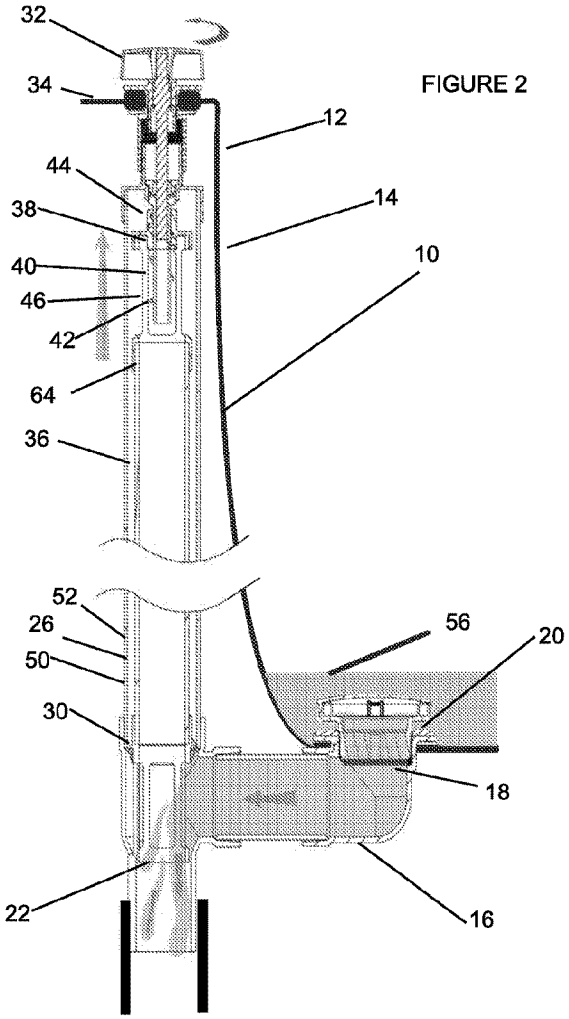
FIG. 2 is a section of the apparatus of FIG. 1 shown in a drainage position.

Referring to FIGS. 1 and FIG. 2, a section of the apparatus 10 of FIG. 1 shown in a drainage position, the barrier 26 is moveable from the fill position, shown in FIG. 1, to a drainage position shown in FIG. 2, in which the barrier 26 has been lifted from the outlet 22, breaking the seal 30 and allowing fluid to flow from the inlet 18 to the outlet 22.

Referring back to FIG. 1, the apparatus 10 further comprises an actuator 32 mounted to an upper surface 34 of the bathtub 14. The actuator 32 is adapted to move the barrier 26 between the fill position and the drainage position.

The barrier 26 is in the form of a pipe 36 connected to the actuator 32 by actuator mechanism 38. The actuator mechanism 38 comprises a first portion 40, connected to the actuator 32, the first portion 40 defining an external helical profile 44 and a $2^{nd}$ portion 46 connected to the barrier pipe 36, the $2^{nd}$ portion comprising a collar 42 defining a complimentary internal profile to the external helical profile 44 of the first portion 40.

Rotation of the actuator 32 results incorporation of the external helical profile 44 of the actuator mechanism first portion 40 with the complimentary internal profile of the actuator mechanism collar 42 to convert the rotation of the actuator 32 into vertical movement of the barrier pipe 36.

The actuator mechanism $2^{nd}$ portion 46 further comprises an open sided linkage mechanism 64 connecting the actuator mechanism to the barrier 26, the purpose of the linkage mechanism 64 being described hereafter.

The barrier pipe 36 is housed within a body pipe 50. The barrier pipe 36 and the body pipe 50 define an annular bypass 52 adapted to permit fluid otherwise being prevented from flowing through the body 16 by the barrier 26 to bypass the barrier 26 when the barrier 26 is in the fill position and, in use, when a threshold depth of water is exceeded inside the bathtub 14.

The barrier pipe 36 and the body pipe 50 define a bypass inlet 54. As the level of water 56 rises within the bathtub 14, fluid flows up the annular bypass 52, the level of fluid in the bypass 52 matching the level of fluid in the bathtub 14.

Referring to FIG. 3, a section of the apparatus 10 of FIG. 1 when an overflow condition has been reached, in the fill position an upper edge 60 of the barrier pipe 50 is set at the same height as a threshold a depth of water 62, predetermined by the installer of the bathtub as equating to the maximum desired fill level of the bathtub 14.

Once the fluid in the bypass 52 reaches the pipe upper edge 60, the water flows through the open sided linkage mechanism 64 over the pipe upper edge 60. The open sided linkage mechanism 64 and the pipe upper edge 60 cooperates to form a circumferential weir 66, fluid flowing over the weir 66 dropping through a barrier pipe through bore 68, and the body outlet 22, in to the soil stack 24.

Referring back to FIG. 2, to drain the bathtub 14, a simple rotation of the actuator 32 will lift the barrier 26 away from the body outlet 22, breaking the seal 30 and allowing fluid to flow through the body 16. The enlarged size of the body inlet 18, a horizontal body portion 70 and the body outlet 22 facilitates rapid draining of the bathtub 14, minimising the amount of time a user has to remain in the bathtub 14 before opening the access door (not shown)

The invention claimed is:

1. A drainage apparatus for a washing vessel, the drainage apparatus comprising:

a hollow body having a body inlet adapted to be connected to an outlet of the washing vessel and a body outlet adapted to be connected to a soil stack;

a barrier located between the body inlet and the body outlet, the barrier comprising a vertically oriented barrier pipe housed within a vertical portion of the body, wherein an annular bypass is defined between the barrier pipe and the vertical portion of the body, and wherein the barrier pipe is movable between a fill position in which a lower end of the barrier pipe provides an annular seal such that the barrier pipe prevents fluid flow from the body inlet to the body outlet and a drainage position in which the barrier pipe permits fluid flow from the body inlet to the body outlet; and wherein, when in use, when the barrier pipe is arranged in the fill position, the annular bypass is arranged relative to the vertical portion of the body to receive fluid being prevented from flowing through the body while the washing vessel is being filled, and when an overflow condition is reached, water within the annular bypass is permitted to flow over an upper edge of the barrier pipe through an open-sided mechanism, into and through the barrier pipe, to prevent over flow of the washing vessel during filling;

wherein, when the barrier pipe is raised from the body outlet, free-flowing water is permitted from the washing vessel through the inlet to the outlet; and wherein the barrier pipe is actuable between the drainage position and the fill position by an actuator and an actuator mechanism, wherein the actuating mechanism comprises a first portion and a second portion, wherein the first portion defines an external helical profile and the second portion defines a complementary internal profile, wherein rotation of the actuator causes engaging rotation of the first and second portion which moves the barrier pipe between the fill position and the draining position.

2. The drainage apparatus according to claim 1, wherein a lower end of the barrier pipe is configured to form a horizontal seal with a horizontal portion of the body.

3. The drainage apparatus according to claim 1, wherein the annular bypass is arranged to receive fluid from the washing vessel outlet and wherein a level of fluid in the annular bypass corresponds with a level of fluid in the washing vessel until an overflow condition is met.

4. The drainage apparatus according to claim 1, wherein the open-sided mechanism and the upper edge of the barrier pipe cooperate to define a circumferential weir, wherein, when an overflow condition is met, water flows relative to the circumferential weir and through the barrier pipe to the outlet.

5. The drainage apparatus according to claim 4, wherein the circumferential weir lies on a horizontal plane and wherein the weir horizontal plane coincides with a horizontal plane defined by a level of water indicative of overflow level relative to the body of the washing vessel.

* * * * *